US009987840B2

(12) United States Patent
Lieske et al.

(10) Patent No.: US 9,987,840 B2
(45) Date of Patent: Jun. 5, 2018

(54) SCREEN CLEANING APPARATUS AND METHOD

(75) Inventors: Rich Lieske, Winona, MN (US); Rob Lela, Hoffman Estates, IL (US); Trevor Warren, Weymouth (GB)

(73) Assignee: ASM Assembly Systems Switzerland GmbH, Zurich (CH)

( * ) Notice: Subject to any disclaimer, the term of this patent is extended or adjusted under 35 U.S.C. 154(b) by 442 days.

(21) Appl. No.: 13/639,638

(22) PCT Filed: Apr. 1, 2011

(86) PCT No.: PCT/GB2011/000511

§ 371 (c)(1),
(2), (4) Date: Apr. 16, 2013

(87) PCT Pub. No.: WO2011/144887

PCT Pub. Date: Nov. 24, 2011

(65) Prior Publication Data

US 2013/0192484 A1 Aug. 1, 2013

Related U.S. Application Data

(60) Provisional application No. 61/320,853, filed on Apr. 5, 2010.

(51) Int. Cl.
*B41F 35/00* (2006.01)

(52) U.S. Cl.
CPC ..... *B41F 35/003* (2013.01); *B41F 35/005* (2013.01); *B41P 2235/24* (2013.01); *B41P 2235/27* (2013.01)

(58) Field of Classification Search
CPC ..... B41F 35/003; B41F 35/005
USPC ..... 101/425
See application file for complete search history.

(56) References Cited

U.S. PATENT DOCUMENTS 5,125,342 A * 6/1992 Hara ..... B41F 35/06 101/425
5,976,269 A * 11/1999 Hamasaki et al. ..... 134/21
5,991,963 A * 11/1999 Tourigny ..... B41F 35/005 101/423
6,036,787 A * 3/2000 Bennett ..... B41F 35/005 101/423
6,067,907 A * 5/2000 Iwamoto ..... G03G 15/2025 101/423
6,237,484 B1 * 5/2001 Homma ..... B41F 35/005 101/114

(Continued)

*Primary Examiner* — Anthony Nguyen
(74) *Attorney, Agent, or Firm* — Renner, Otto, Boisselle & Sklar, LLP

(57) ABSTRACT

A screen cleaning apparatus (2) and method, wherein: a screen cleaning head (3) is operative to contact a surface of a printing screen (PS), the screen cleaning head (3) includes a screen contact element (17) over which a cleaning sheet (7) is in use disposed, the screen contact element (17) comprises a first section (17*a*), which is configured to support one of a dry section or a wet section of the cleaning sheet (7) thereabove, a second, vacuum section (17*b*), at which a vacuum is provided to draw a vacuum therethrough, and a third section (17*c*), which is configured to support the other of a wet section or a dry section of the cleaning sheet thereabove; and a support (11) to which the cleaning head (3) is supported and which is movable over the surface of the printing screen (PS) to provide for cleaning of the same.

18 Claims, 10 Drawing Sheets

(56) References Cited

U.S. PATENT DOCUMENTS

| | | | | |
|---|---|---|---|---|
| 6,923,312 | B2 * | 8/2005 | Pham et al. | 198/495 |
| 8,317,934 | B2 * | 11/2012 | Kholodenko | H01L 21/02057 134/10 |
| 8,567,314 | B2 * | 10/2013 | Tanaka | B41F 35/005 101/129 |
| 8,844,438 | B2 * | 9/2014 | Nishi | B41F 15/0818 101/123 |
| 2003/0037804 | A1 * | 2/2003 | Erdmann | 134/9 |
| 2003/0209158 | A1 * | 11/2003 | Porat | 101/425 |
| 2004/0244618 | A1 * | 12/2004 | Egan | B41F 35/02 101/425 |
| 2005/0183594 | A1 | 8/2005 | Perault et al. | |
| 2006/0137553 | A1 * | 6/2006 | Corti | B41F 35/06 101/425 |
| 2007/0295231 | A1 * | 12/2007 | de Sousa | B41F 35/005 101/425 |
| 2008/0296311 | A1 * | 12/2008 | Read | H05K 13/0469 221/1 |

* cited by examiner

SCREEN CLEANING APPARATUS AND METHOD

This application is a national phase of International Application No. PCT/GB2011/000511 filed Apr. 1, 2011 and published in the English language.

The present invention relates to a screen cleaning apparatus and method for cleaning a printing screen, often alternatively referred to as a stencil or foil, and a screen cleaning head for use with the same.

Printing screens, such as used in printing on circuit boards and solar cells, are prone to collection of printing medium on the underside and in the printing apertures, which reduces performance, particularly the transfer efficiency, and, in the printing of solar cells, can lead to wafer breakage.

Many under-screen cleaners exist, such as the Cyclone under-screen cleaner as supplied by DEK and disclosed in U.S. Pat. No. 6,036,787.

It is an aim of the present invention to provide an improved screen cleaning apparatus and method for cleaning a printing screen and a screen cleaning head for use with the same, particularly for use in reducing the cycle time of the cleaning operation and reducing usage of cleaning sheet material.

In one aspect the present invention provides a screen cleaning apparatus, comprising: a screen cleaning head which is operative to contact a surface of a printing screen, wherein the screen cleaning head includes a screen contact element over which a cleaning sheet is in use disposed, the screen contact element comprising a first section, which is configured to support one of a dry section or a wet section of the cleaning sheet thereabove, a second, vacuum section, at which a vacuum is provided to draw a vacuum through the cleaning sheet thereabove, and a third section, which is configured to support the other of a wet section or a dry section of the cleaning sheet thereabove; and a support to which the cleaning head is supported and which is movable over the surface of the printing screen to provide for cleaning of the same.

In one embodiment the vacuum section is disposed intermediate the first and third sections.

In one embodiment the vacuum section comprises a first elongate vacuum aperture adjacent the first section, a second elongate vacuum aperture adjacent the second section and a support platform disposed intermediate the vacuum apertures.

In one embodiment the first section is a flat section.

In one embodiment the third section is a flat section.

In one embodiment the first section, the vacuum section and the third section have substantially the same length in the direction of movement of the cleaning head.

In one embodiment the cleaning head comprises an elongate wiper, preferably in the form of a wiper bar, which extends across the surface of the printing screen.

In one embodiment the cleaning head provides for cleaning of the surface of the printing screen in a single sweep when moved in a single sweeping direction over the surface of the printing screen, and the first section is a screen drying section, which is configured to support a dry section of the cleaning sheet thereabove, and the third section is a screen wetting section, which is configured to support a wet section of the cleaning sheet thereabove and is upstream of the vacuum and screen drying sections in the sweeping direction.

In another embodiment the cleaning head provides for cleaning of the surface of the printing screen in a single sweep when moved in one of two, opposite sweeping directions over the surface of the printing screen, wherein, when the cleaning head is moved in one sweeping direction, the first section is a screen drying section, which is configured to support a dry section of the cleaning sheet thereabove, and the third section is a screen wetting section, which is configured to support a wet section of the cleaning sheet thereabove and is upstream of the vacuum and screen drying sections in the one sweeping direction, and, when the cleaning head is moved in the other sweeping direction, the first section is a screen wetting section, which is configured to support a wet section of the cleaning sheet thereabove, and the third section is a screen drying section, which is configured to support a dry section of the cleaning sheet thereabove and is downstream of the screen wetting and vacuum sections in the other sweeping direction.

In one embodiment the cleaning head further comprises a cleaning fluid supply which is operative to supply a cleaning fluid across a section of the cleaning sheet.

In one embodiment the cleaning fluid supply comprises an elongate fluid supply member which includes a plurality of fluid delivery outlets for delivering a cleaning fluid across a section of the cleaning sheet.

In one embodiment the fluid supply member includes a fluid supply manifold which is fluidly connected to the fluid delivery outlets and a fluid source, whereby operation of the fluid source acts to deliver cleaning fluid from the delivery outlets across a section of the cleaning sheet.

In one embodiment the fluid supply member is disposed adjacent the first section.

In one embodiment the size of the wetted section of the cleaning sheet is determined by the time period for which the cleaning fluid supply is operated to deliver fluid.

In one embodiment the cleaning fluid supply is operated to wet a section of the cleaning sheet which has a length in the direction of movement of the cleaning head which corresponds substantially to the length of the screen wetting section in the direction of movement of the cleaning head.

In one embodiment the apparatus further comprises: a feed unit for feeding a cleaning sheet to the cleaning head and over the screen contact element thereof.

In one embodiment the feed unit comprises a supply roll of the cleaning sheet, a take-up roll onto which used cleaning sheet is wound, and a drive which is operative to draw a section of the cleaning sheet as wetted by the cleaning fluid supply to overly the screen wetting section.

In one embodiment the apparatus further comprises: a positioning unit for raising and lowering the cleaning head into and out of contact with the printing screen.

In one embodiment the apparatus further comprises: an oscillator for applying an oscillating motion to the cleaning head.

In one embodiment the cleaning sheet comprises a fabric sheet.

In another aspect the present invention provides a screen printing machine incorporating the above-described screen cleaning apparatus.

In one embodiment the machine further comprises: a carriage for moving the cleaning head across the surface of the printing screen.

In one embodiment the carriage is the carriage for moving a vision camera.

In a further aspect the present invention provides a screen cleaning head for cleaning a printing screen, wherein the screen cleaning head includes a screen contact element over which a cleaning sheet is in use disposed, the screen contact element comprising a first section, which is configured to support one of a dry section or a wet section of the cleaning sheet thereabove, a second, vacuum section, at which a vacuum is provided to draw a vacuum through the cleaning sheet, and a third section, which is configured to support the other of a wet section or a dry section of the cleaning sheet thereabove.

In one embodiment the vacuum section is disposed intermediate the first and third sections.

In one embodiment the vacuum section comprises a first elongate vacuum aperture adjacent the first section, a second elongate vacuum aperture adjacent the second section and a support platform disposed intermediate the vacuum apertures.

In one embodiment the first section is a flat section.

In one embodiment the third section is a flat section.

In one embodiment the first section, the vacuum section and the third section have substantially the same length in the direction of movement of the cleaning head.

In one embodiment the cleaning head comprises an elongate wiper, preferably in the form of a wiper bar.

In a still further aspect the present invention provides a method of cleaning a printing screen, comprising the steps of: providing a screen cleaning head, wherein the screen cleaning head includes a screen contact element over which a cleaning sheet is disposed, the screen contact element comprising a first section, which supports one of a dry section or a wet section of the cleaning sheet thereabove, a second, vacuum section, at which a vacuum is provided to draw a vacuum through the cleaning sheet, and a third section, which supports the other of a wet section or a dry section of the cleaning sheet thereabove; wetting a section of the cleaning sheet; moving the wetted section of the cleaning sheet to overly the screen wetting section; applying a vacuum to the vacuum section; and moving the cleaning head over a surface of the printing screen to provide for cleaning of the same.

In one embodiment the vacuum section is disposed intermediate the first and third sections.

In one embodiment the vacuum section comprises a first elongate vacuum aperture adjacent the first section, a second elongate vacuum aperture adjacent the second section and a support platform disposed intermediate the vacuum apertures.

In one embodiment the first section is a flat section.

In one embodiment the third section is a flat section.

In one embodiment the first section, the vacuum section and the third section have substantially the same length in the direction of movement of the cleaning head.

In one embodiment the cleaning head comprises an elongate wiper, preferably in the form of a wiper bar, which extends across the printing screen.

In one embodiment the cleaning head provides for cleaning of the surface of the printing screen in a single sweep when moved in a single sweeping direction over the surface of the printing screen, and the first section is a screen drying section, which supports a dry section of the cleaning sheet thereabove, and the third section is a screen wetting section, which supports a wet section of the cleaning sheet thereabove and is upstream of the vacuum and screen drying sections in the sweeping direction.

In another embodiment the cleaning head provides for cleaning of the surface of the printing screen in a single sweep when moved in one of two, opposite sweeping directions over the surface of the printing screen, wherein, when the cleaning head is moved in one sweeping direction, the first section is a screen drying section, which supports a dry section of the cleaning sheet thereabove, and the third section is a screen wetting section, which supports a wet section of the cleaning sheet thereabove and is upstream of the vacuum and screen drying sections in the one sweeping direction, and, when the cleaning head is moved in the other sweeping direction, the first section is a screen wetting section, which supports a wet section of the cleaning sheet thereabove, and the third section is a screen drying section, which supports a dry section of the cleaning sheet thereabove and is downstream of the screen wetting and vacuum sections in the other sweeping direction.

In one embodiment the step of wetting the cleaning sheet comprises the step of: supplying a cleaning fluid across a section of the cleaning sheet using a cleaning fluid supply.

In one embodiment the cleaning fluid supply comprises an elongate fluid supply member which includes a plurality of fluid delivery outlets for delivering a cleaning fluid across a section of the cleaning sheet.

In one embodiment the fluid supply member includes a fluid supply manifold which is fluidly connected to the fluid delivery outlets, and the step of wetting the cleaning sheet comprises the step of: operating a fluid source to deliver cleaning fluid from the delivery outlets across a section of the cleaning sheet.

In one embodiment the fluid supply member is disposed adjacent the first section.

In one embodiment the step of wetting the cleaning sheet comprises the step of: operating the cleaning fluid supply for a predetermined period of time to provide a wetted section of predetermined size.

In one embodiment the cleaning fluid supply is operated to wet a section of the cleaning sheet which has a length in the direction of movement of the cleaning head which corresponds substantially to the length of the screen wetting section in the direction of movement of the cleaning head.

In one embodiment the cleaning sheet is provided on a supply roll and the step of moving the wetted section of the cleaning sheet comprises the step of: drawing a predetermined length of the cleaning sheet from the supply roll onto a take-up roll, such as to move the wetted section of the cleaning sheet to overly the screen wetting section.

In one embodiment the method further comprises the steps of: raising the cleaning head into contact with the printing screen prior to the step of moving the cleaning head; and lowering the cleaning head out of contact with the printing screen subsequent to the step of moving the cleaning head.

In one embodiment the method further comprises the step of: applying an oscillating motion to the cleaning head.

In one embodiment the cleaning head is moved across the surface of the printing screen by operation of a carriage for a vision camera.

In one embodiment the cleaning sheet comprises a fabric sheet.

A preferred embodiment of the present invention will now be described hereinbelow by way of example only with reference to the accompanying drawings, in which.

Figure 1:
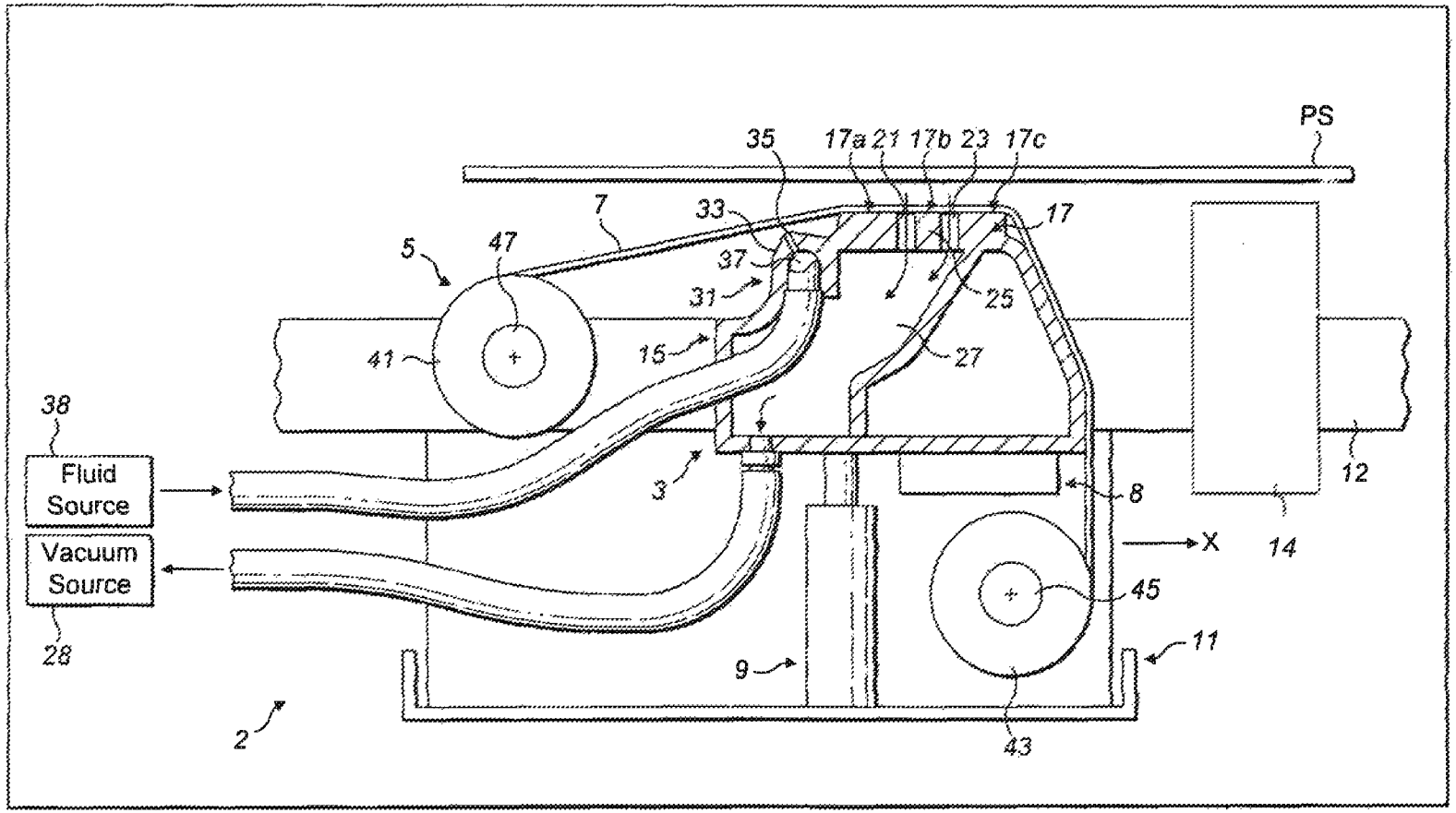
FIG. 1 illustrates a screen printing machine incorporating a screen cleaning apparatus in accordance with a preferred embodiment of the present invention.
Figure 2:
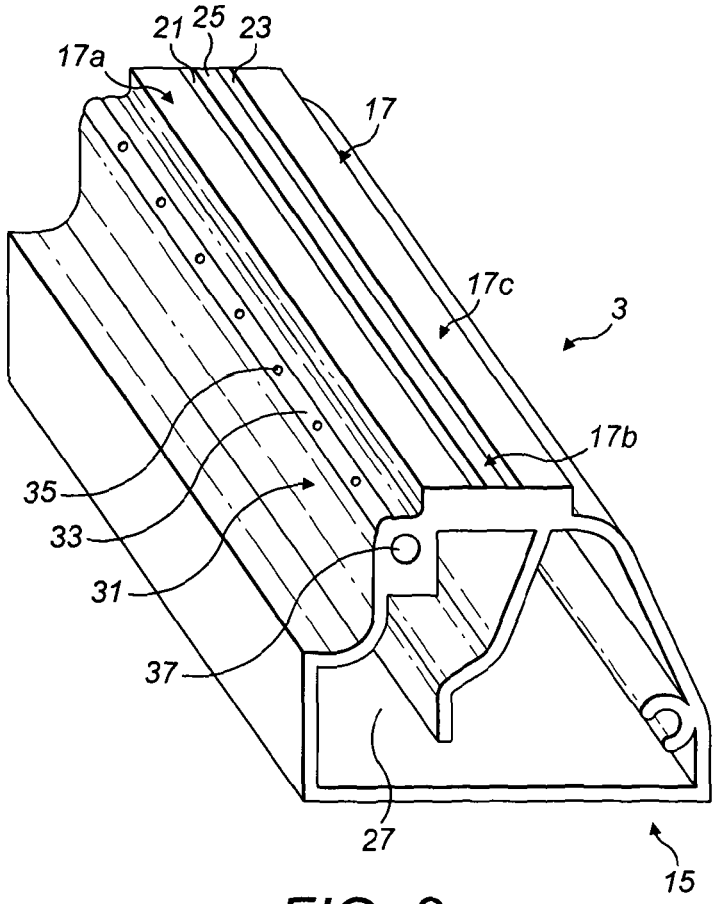
FIG. 2 illustrates a fragmentary perspective view of the cleaning head of the screen cleaning apparatus of FIG. 1.

The screen printing machine 1 comprises a screen cleaning apparatus 2 for cleaning the underside of a printing screen PS when mounted in the screen printing machine 1.

The screen cleaning apparatus 2 comprises a screen cleaning head 3 which is operative to contact an underside of a printing screen PS, a feed unit 5 for feeding a cleaning sheet 7 to the cleaning head 3, an oscillator unit 8 for oscillating the cleaning head 3, a positioning unit 9 for raising and lowering the cleaning head 3 into and out of contact with the printing screen PS, and a support 11 to which the cleaning head 3 is supported and which is movable in a transport direction X over the underside of the printing screen PS to provide for cleaning of the same, in this embodiment by the carriage 12 for the imaging camera 14 of the screen printing machine 1.

The cleaning head 3 comprises an elongate wiper 15, in this embodiment in the form of a wiper bar, which extends across a width of the printing screen PS which is to be cleaned.

The wiper 15 includes a screen contact element 17 at an upper surface thereof which faces the underside of the printing screen PS and over which is provided a section of the cleaning sheet 7, whereby, when the cleaning head 3 is raised to a screen contact position, the screen contact element 17 contacts the underside of the printing screen PS.

The screen contact element 17 comprises a first, screen drying section 17*a*, in this embodiment a flat section, which is configured to support a dry section of the cleaning sheet 7 thereabove, a second, vacuum section 17*b*, at which a vacuum is provided to draw residue into the cleaning sheet 7 and cause the printing screen PS to be drawn onto the screen contact element 17 and thereby into firm, positive contact with the cleaning sheet 7, and a third, screen wetting section 17*c*, in this embodiment a flat section, which is configured to support a wet section of the cleaning sheet 7 thereabove, as will be described in more detail hereinbelow.

With this configuration, the cleaning head 3 provides for cleaning of the printing screen PS in a single sweep over the printing screen PS, with the screen wetting section 17*c* of the screen contact element 17 defining the leading edge of the cleaning head 3 and the screen drying section 17*a* of the screen contact element 17 defining the trailing edge of the cleaning head 3, whereby the underside of the printing screen PS is first wetted by a wet section of the cleaning sheet 7 thereabove, subsequently wetted residue is drawn into the cleaning sheet 7 at the vacuum section 17*b*, with the vacuum simultaneously acting to draw the printing screen PS onto the screen contact element 17, and finally the underside of the cleaned printing screen PS is dried at the screen drying section 17*c*.

By enabling the wetting, vacuum and drying steps to be performed in a single sweep, the cycle time for the cleaning operation is shortened as compared to the existing Cyclone under-screen cleaner, by one-third where the existing cleaner performs only the wetting and vacuum steps in separate sweeps and by two-thirds where the existing cleaner performs the wetting, vacuum and drying steps in separate sweeps. This shortened cycle time can allow for a cleaning operation to be performed after each printing operation, which is necessary for some processes and also prevents the accumulation of print material. Also, usage of the cleaning sheet 7 is similarly reduced by one-third or two-thirds as compared to the existing cleaner.

In addition, by having the screen wetting section 17*c* at the leading edge of the cleaning head 3, the cleaning head 3 allows for cleaning to commence immediately the cleaning head 3 is removed from the storage station.

In this embodiment the vacuum section 17*b* of the screen contact element 17 comprises a first elongate vacuum aperture 21 adjacent the screen drying section 17*a* of the screen contact element 17, a second elongate vacuum aperture 23 adjacent the screen wetting section 17*c* of the screen contact element 17 and an elongate support platform 25 disposed intermediate the vacuum apertures 21, 23.

In this embodiment the screen drying section 17*a*, the vacuum section 17*b* and the screen wetting section 17*c* have substantially the same length in the transport direction X of the cleaning head 3.

In this embodiment the wiper 15 comprises a vacuum manifold 27 which extends along the length of the wiper 15 and to which the vacuum section 17*b* of the screen contact element 17 and a vacuum source 28 are fluidly connected, whereby a vacuum is drawn through the length of the vacuum section 17*b* of the screen contact element 17 on operation of the vacuum source 28. In this embodiment the vacuum source 28 is operated only during the cleaning operation, but in an alternative embodiment could be operated continuously.

The cleaning head 3 further comprises a fluid supply 31 which is operative to supply a cleaning fluid across a width of a section of the cleaning sheet 7.

In this embodiment the fluid supply 31 comprises an elongate fluid supply member 33 which includes a plurality of fluid delivery outlets 35, arranged in spaced relation along a length thereof, for delivering a cleaning fluid across a width of a section of the cleaning sheet 7.

In this embodiment the fluid supply member 33 includes a fluid supply manifold 37 which is a fluidly connected to the fluid delivery outlets 35 and a fluid source 38, in this embodiment a pump, whereby operation of the fluid source 38 acts to deliver cleaning fluid from the delivery outlets 35 across a width of a section of the cleaning sheet 7.

In this embodiment the size of the wetted section of the cleaning sheet 7 is determined by the time period for which the fluid source 38 is operated to deliver fluid. In this embodiment the fluid source 38 is operated to wet a section of the cleaning sheet 7 which has a length in the transport direction X which corresponds substantially to the length of the screen wetting section 17*c* of the screen contact element 17 in the transport direction X.

In this embodiment the feed unit 5 comprises a supply roll 41 of the cleaning sheet 7, a take-up roll 43 onto which used cleaning sheet 7 is wound, and a drive 45, here a drive motor, which is operative to draw a predetermined length of the cleaning sheet 7 over the cleaning head 3, here a length which is such as to draw a section of the cleaning sheet 7 as wetted by the fluid supply member 35 to the screen wetting section 17*c* of the screen contact element 17.

In this embodiment the supply roll 41 includes a drag mechanism 47 which provides a frictional torque against which the cleaning sheet 7 is drawn by the drive 45.

In this embodiment the fluid supply member 35 is disposed adjacent the screen drying section 17*a* of the screen contact element 17, and in a preferred embodiment, as in this embodiment, is integrally formed with the wiper 15, here from a single extrusion.

In this embodiment the cleaning sheet 7 comprises a fabric sheet, such as DEK SMT High Performance Cleaning Roll as supplied by DEK.

The oscillator unit 8, in this embodiment a motor-driven unit, is operative to oscillate the cleaning head 3 over the surface of the printing screen PS, in this embodiment in a back-and-forth motion in the transport direction X. In this embodiment the oscillator unit 8 is operative to oscillate the cleaning head 3 and the feed unit 5 in conjunction.

In this embodiment the positioner 9 comprises an actuator, here a pneumatic actuator, for raising and lowering the cleaning head 3 between a lowered, rest position and a raised, screen contact position.

Figure 3A:
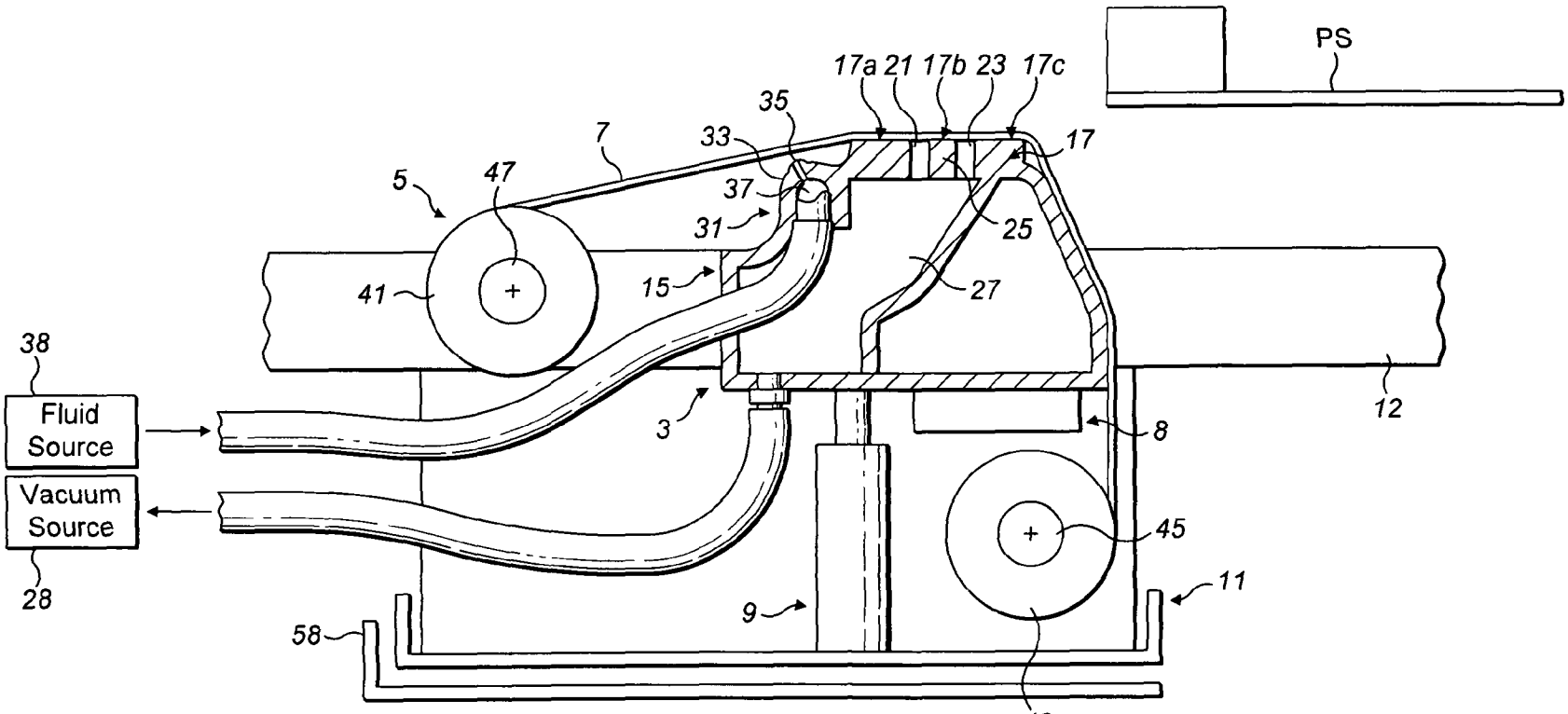
FIGS. 3(*a*) to (*h*) illustrate the operational steps in the operation of the screen cleaning apparatus of FIG. 1.
Figure 3B:
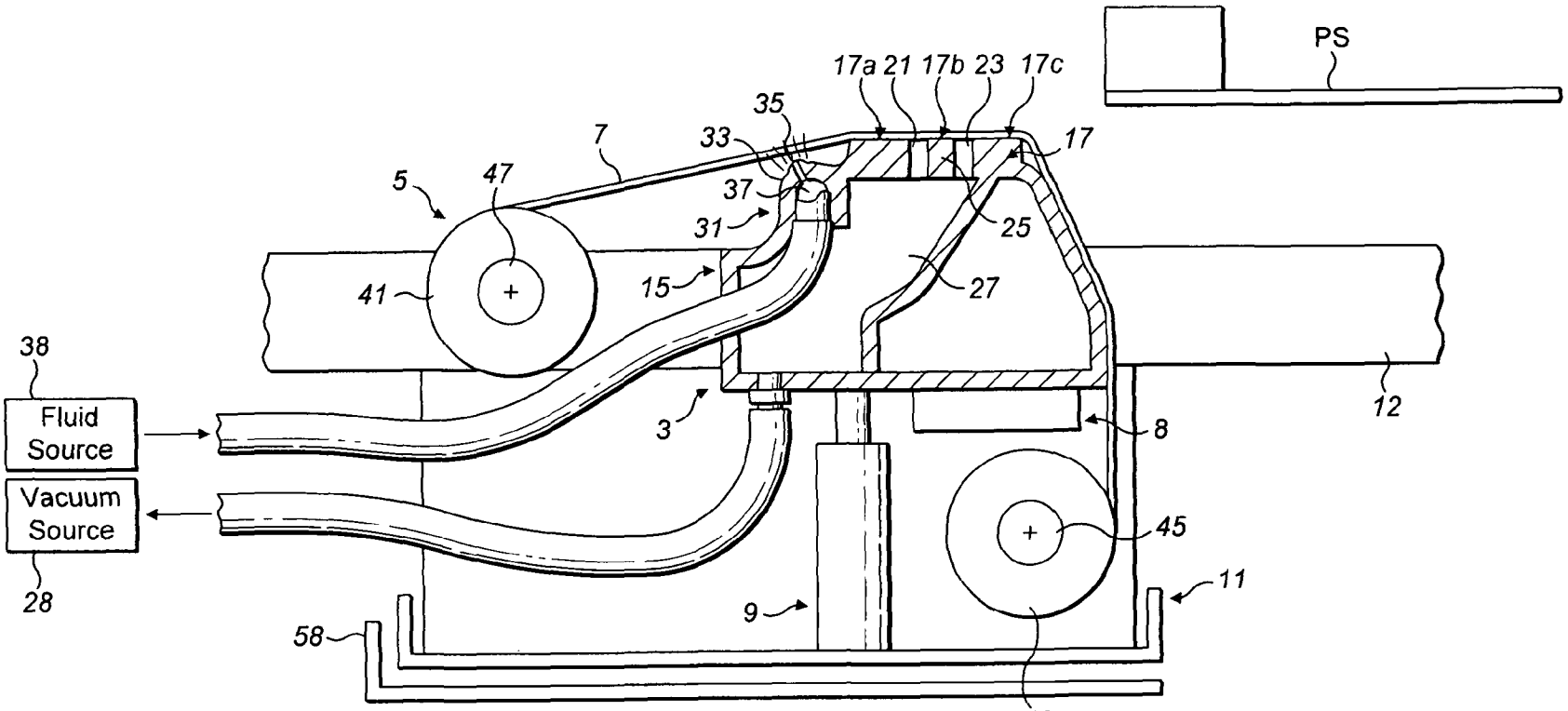
Figure 3C:
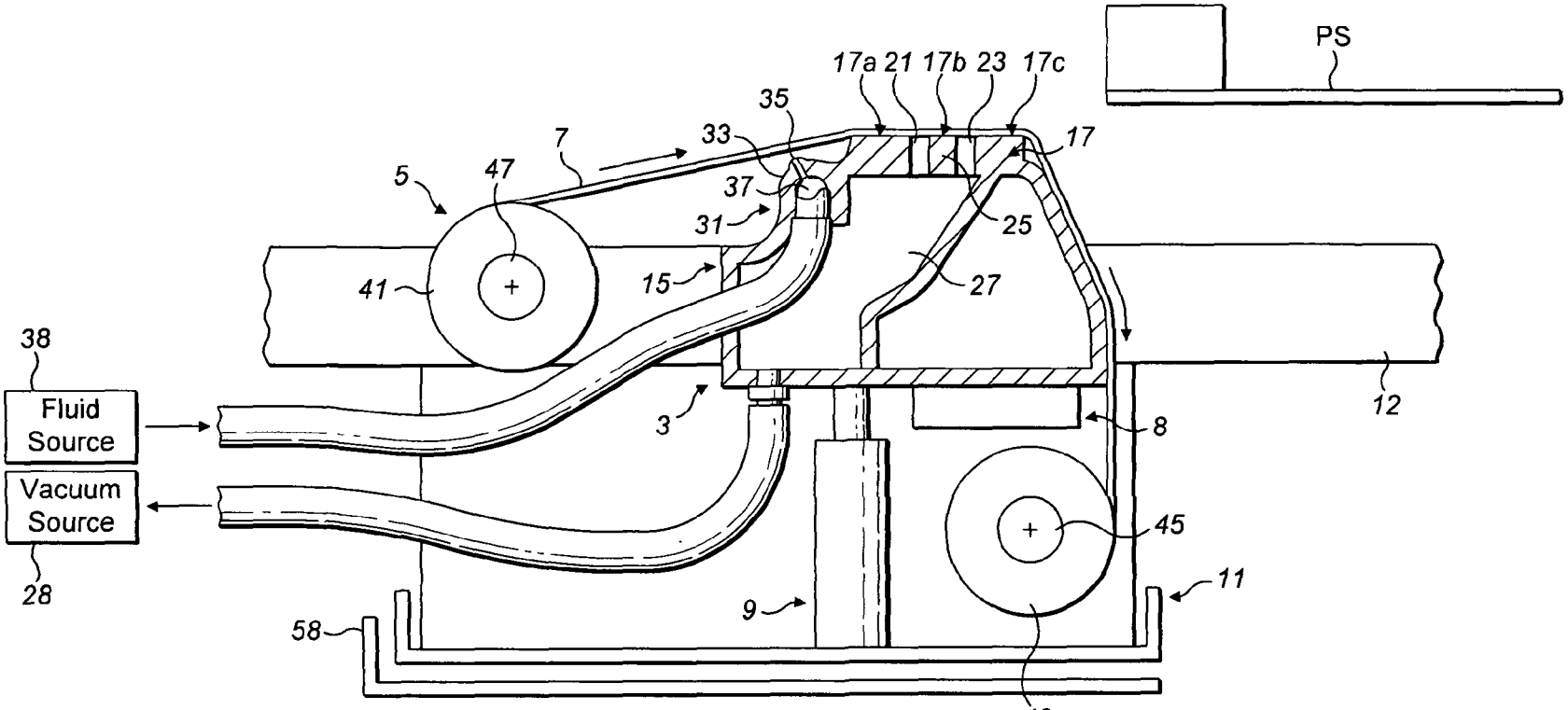
Figure 3D:
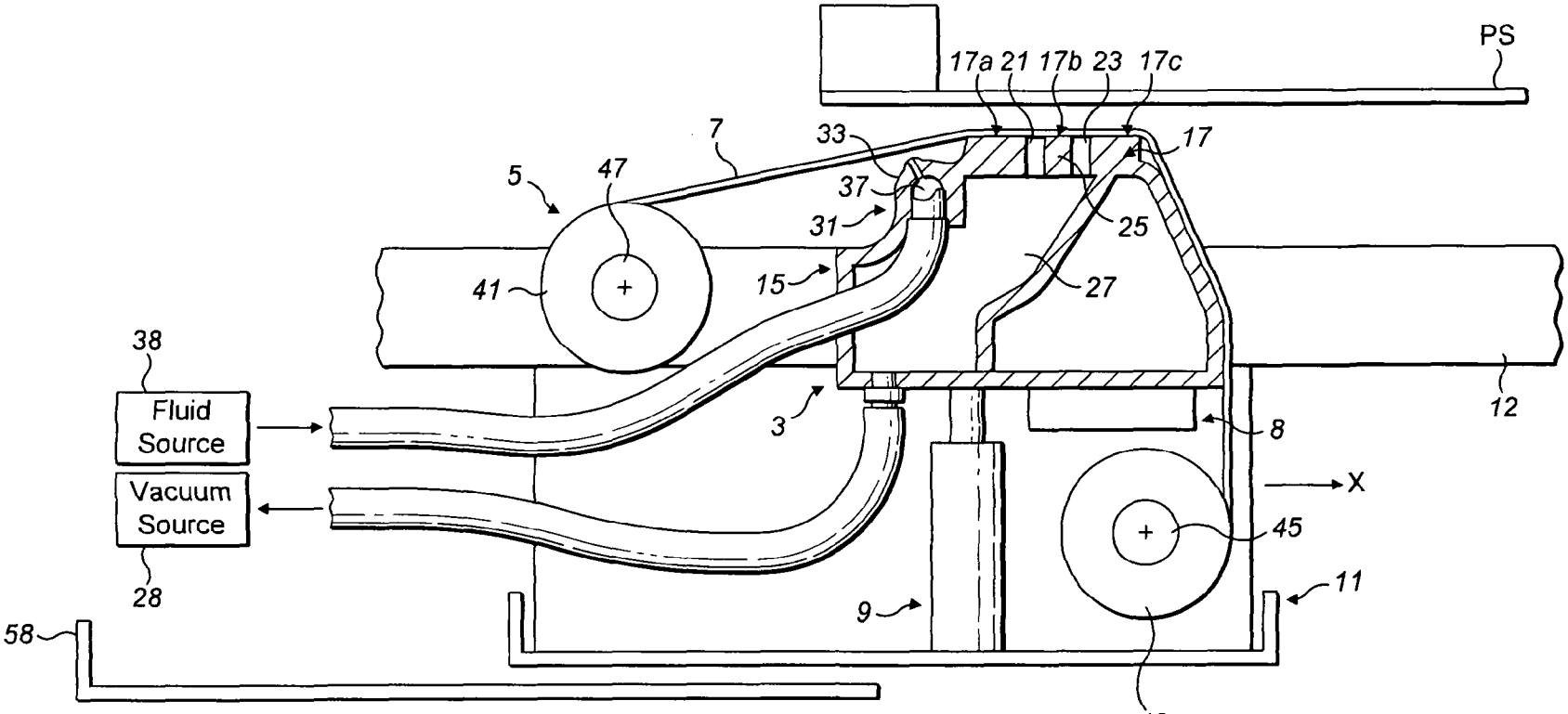
Figure 3E:
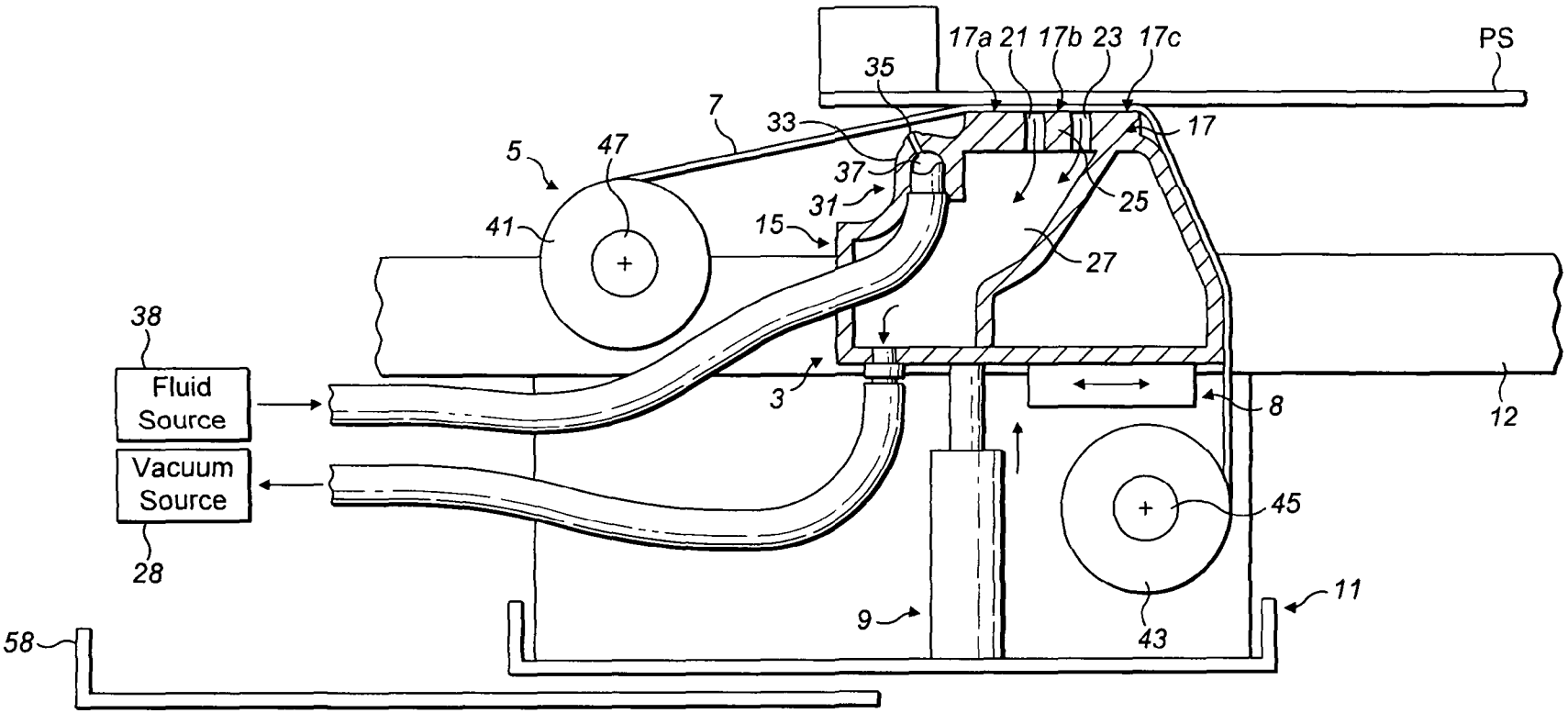
Figure 3F:
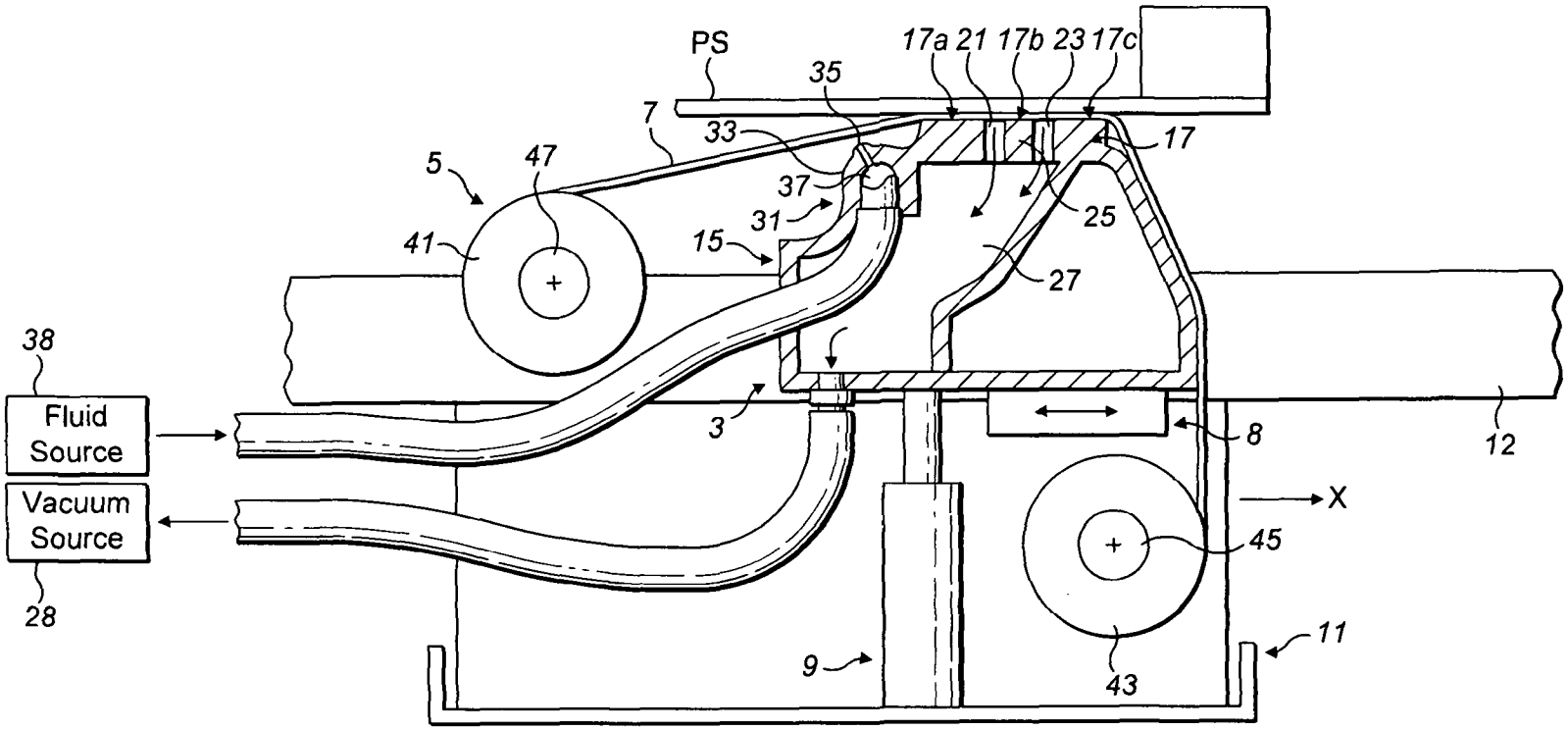
Figure 3G:
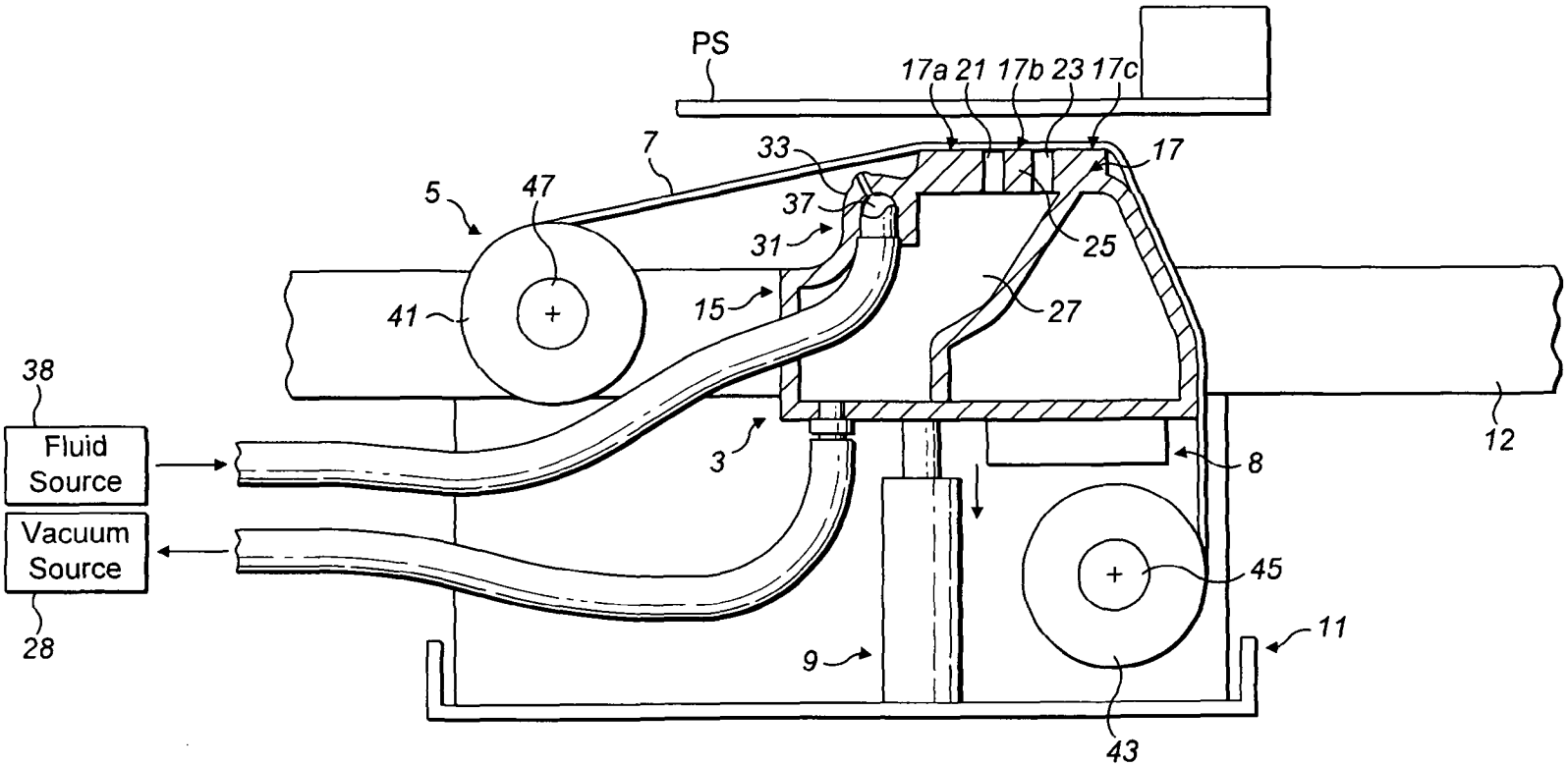
Figure 3H:
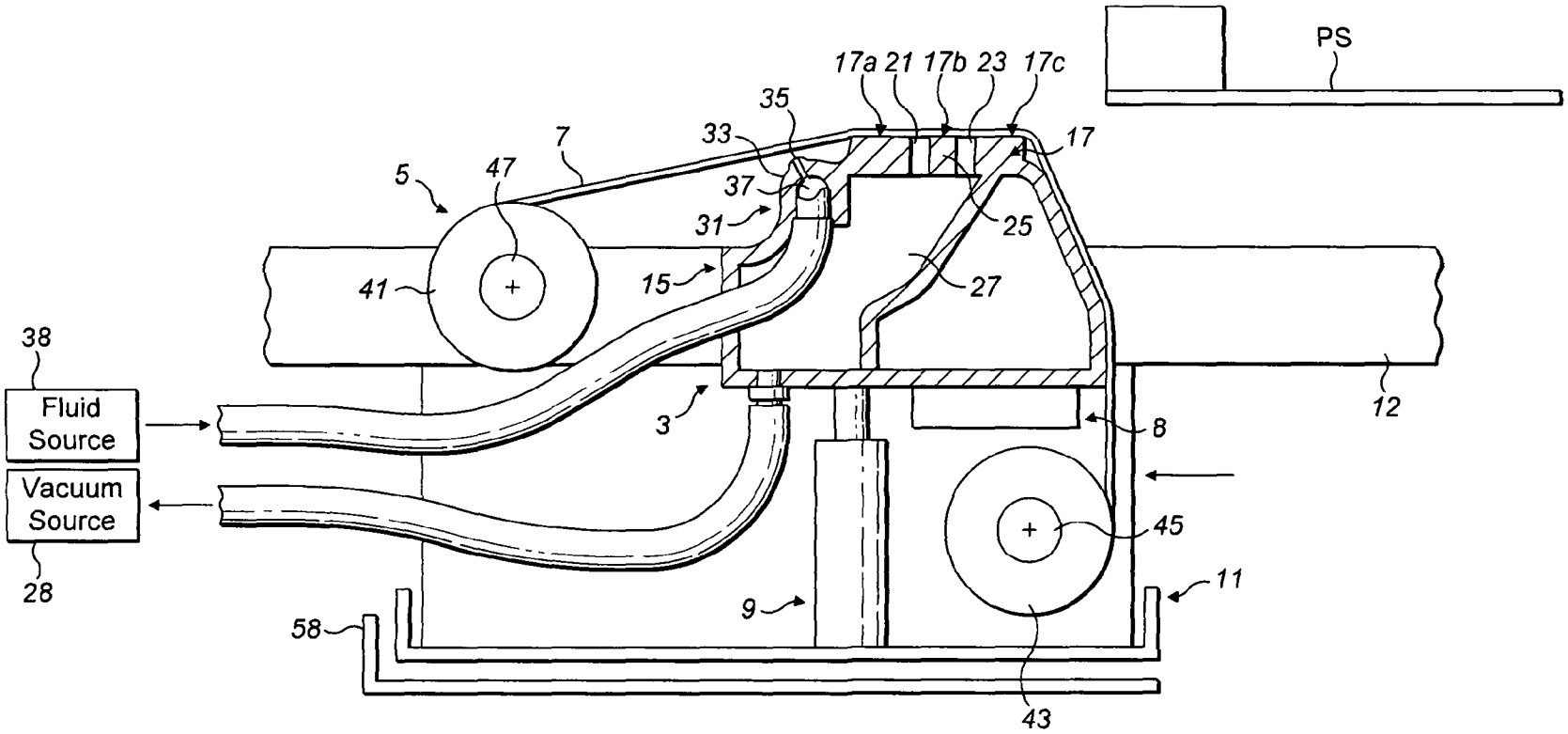

Operation of the screen cleaning apparatus 2 will now be described hereinbelow with reference to FIGS. 3(*a*) to (*h*) of the accompanying drawings.

FIG. 3(*a*) illustrates the cleaning head 3 parked at a home station 58.

In a first step, as illustrated in FIG. 3(*b*), the fluid supply 31 is actuated to supply a cleaning fluid across a width of a section of the cleaning sheet 7, in this embodiment by operation of the fluid source 38 for a predetermined period of time to wet a predetermined length of the cleaning sheet 7 in the transport direction X which corresponds to the length of the screen wetting section 17*c* of the screen contact element 17 in the transport direction X.

In a second step, as illustrated in FIG. 3(*c*), the feed unit 5 is operated to draw a predetermined length of the cleaning sheet 7 over the cleaning head 3, in this embodiment a length which is such as to draw the wetted section of the cleaning sheet 7 to overly the screen wetting section 17*c* of the screen contact element 17.

In a third step, as illustrated in FIG. 3(*d*), the cleaning head 3 is advanced to be adjacent one edge of the printing screen PS, in this embodiment a front edge of the printing screen PS as mounted in the screen printing machine 1.

In a fourth step, as illustrated in FIG. 3(*e*), the oscillator unit 8 is actuated to oscillate the cleaning head 3, the positioning unit 9 is operated to raise the cleaning head 3 to the screen cleaning position and the vacuum source 28 is actuated to draw a vacuum through the vacuum section 17*b* of the screen contact element 17, whereby the vacuum acts to draw the printing screen PS onto the screen contact element 17.

In a fifth step, as illustrated in FIG. 3(*f*), the cleaning head 3 is moved, in this embodiment by the carriage 12 of the vision camera of the screen printing machine 1, across the length of the underside of the printing screen PS to the opposite edge of the printing screen PS in a single sweep, in this embodiment the rear edge of the printing screen PS as mounted in the screen printing machine 1.

In a sixth step, as illustrated in FIG. 3(*g*), the oscillator unit 8 and the vacuum source 28 are de-actuated and the positioning unit 9 is operated to lower the cleaning head 3 to the rest position.

In a final step, as illustrated in FIG. 3(*h*), the cleaning head 3 is returned to the home station 58, in this embodiment by the carriage 12 of the vision camera of the screen printing machine 1.

Finally, it will be understood that the present invention has been described in its preferred embodiment and can be modified in many different ways without departing from the scope of the invention as defined by the appended claims.

For example, in other modes of operation, the screen cleaning apparatus 2 would allow for the wetting, vacuum and drying steps to be performed in separate sweeps or a pair of the steps, that is the wetting and vacuum steps or the vacuum and drying steps, to be performed in one sweep and the other step, that is, the drying step or the wetting step, to be performed in a second sweep.

Also, the cleaning head 3 could be configured to clean when moved in the opposite direction, with the screen drying section 17*a* of the screen contact element 17 becoming the screen drying section and the screen wetting section 17*c* of the screen contact element 17 becoming the screen drying section. This configuration would allow the home station 58 to be located to the rear of the printing screen PS as mounted in the screen printing machine 1. In another embodiment the screen cleaning apparatus 2 could be configured to clean when the cleaning head 3 is moved in both directions, and in this embodiment the screen printing machine 1 would include two home stations 58 disposed to the respective edges of the printing screen PS.

The invention claimed is:

1. A method of cleaning a printing screen, comprising the steps of:

providing a screen cleaning head, wherein the screen cleaning head includes a screen contact element over which a cleaning sheet is disposed, wherein the screen contact element comprises a first section, which supports one of a dry section or a wet section of the cleaning sheet thereabove and providing one of a screen wetting or screen drying section, a second, vacuum section, at which a vacuum is provided to draw a vacuum through the cleaning sheet, and a third section, which supports the other of a wet section or a dry section of the cleaning sheet thereabove when the first section supports the different one of a dry section or a wet section of the cleaning sheet thereabove and providing the other of the screen wetting or screen drying section;

wetting a section of the cleaning sheet;

drawing a predetermined length of the cleaning sheet over the cleaning head from a supply roll onto a take-up roll to cause the wetted section of the cleaning sheet to overlies the screen wetting section and a dry section of the cleaning sheet to overlies the screen drying section;

applying a vacuum to the vacuum section; and moving the cleaning head over a surface of the printing screen to provide for cleaning of the printing screen.

2. The method of claim 1, wherein the vacuum section is disposed intermediate the first and third sections.

3. The method of claim 1, wherein the first section and/or the third section is a flat section.

4. The method of claim 1, wherein the first section, the vacuum section and the third section have substantially the same length in the direction of movement of the cleaning head.

5. The method of claim 1, wherein the cleaning head comprises an elongate wiper or wiper bar, which extends across the printing screen.

6. The method of claim 1, wherein the cleaning head provides for cleaning of the surface of the printing screen in a single sweep when moved in a single sweeping direction over the surface of the printing screen, and the first section is a screen drying section, which supports a dry section of the cleaning sheet thereabove, and the third section is a screen wetting section, which supports a wet section of the cleaning sheet thereabove and is upstream of the vacuum and screen drying sections in the sweeping direction.

7. The method of claim 1, wherein the step of wetting the cleaning sheet comprises the step of:

supplying a cleaning fluid across a section of the cleaning sheet using a cleaning fluid supply.

8. The method of claim 1, further comprising the steps of:

raising the cleaning head into contact with the printing screen prior to the step of moving the cleaning head; and lowering the cleaning head out of contact with the printing screen subsequent to the step of moving the cleaning head.

9. The method of claim 1, further comprising the step of:

applying an oscillating motion to the cleaning head.

10. The method of claim 1, further comprising the step of:

providing a carriage for moving a vision camera: and wherein the step of moving the cleaning head is performed by operating the carriage.

11. The method of claim 1, wherein the cleaning sheet comprises a fabric sheet.

12. The method of claim 1, wherein the vacuum section comprises a first elongate vacuum aperture adjacent the first section, a second elongate vacuum aperture adjacent the second section and a support platform disposed intermediate the vacuum apertures.

13. The method of claim 1, wherein the cleaning head provides for cleaning of the surface of the printing screen in a single sweep when moved in one of two, opposite sweeping directions over the surface of the printing screen, wherein, when the cleaning head is moved in one sweeping direction, the first section is a screen drying section, which supports a dry section of the cleaning sheet thereabove, and the third section is a screen wetting section, which supports a wet section of the cleaning sheet thereabove and is upstream of the vacuum and screen drying sections in the one sweeping direction, and, when the cleaning head is moved in the other sweeping direction, the first section is a screen wetting section, which supports a wet section of the cleaning sheet thereabove, and the third section is a screen drying section, which supports a dry section of the cleaning sheet thereabove and is downstream of the screen wetting and vacuum sections in the other sweeping direction.

14. The method of claim 7, wherein the cleaning fluid supply comprises an elongate fluid supply member which includes a plurality of fluid delivery outlets for delivering a cleaning fluid across a section of the cleaning sheet.

15. The method of claim 14, wherein the fluid supply member includes a fluid supply manifold which is fluidly connected to the fluid delivery outlets, and the step of wetting the cleaning sheet comprises the step of:

operating a fluid source to deliver cleaning fluid from the delivery outlets across a section of the cleaning sheet.

16. The method of claim 14, wherein the fluid supply member is disposed adjacent the first section.

17. The method of claim 7, wherein the step of wetting the cleaning sheet comprises the step of:

operating the cleaning fluid supply for a predetermined period of time to provide a wetted section of predetermined size.

18. The method of claim 17, wherein the cleaning fluid supply is operated to wet a section of the cleaning sheet which has a length in the direction of movement of the cleaning head which corresponds substantially to the length of the screen wetting section in the direction of movement of the cleaning head.

* * * * *